US005301804A

United States Patent [19]

Focke et al.

[11] Patent Number: 5,301,804

[45] Date of Patent: Apr. 12, 1994

[54] PACKAGE, ESPECIALLY SOFT-CUP PACK FOR CIGARETTES

[75] Inventors: Heinz Focke, Verden; Henry Buse, Visselhövede, both of Fed. Rep. of Germany

[73] Assignee: Focke & Co. (GmbH & Co.), Verden, Fed. Rep. of Germany

[21] Appl. No.: 15,132

[22] Filed: Feb. 9, 1993

[30] Foreign Application Priority Data

Feb. 18, 1992 [DE] Fed. Rep. of Germany ..... 4204827

[51] Int. Cl.[5] ..... B65D 85/10; B65D 85/12

[52] U.S. Cl. ..... 206/271; 206/273; 206/254; 206/264

[58] Field of Search ..... 206/271, 273, 265, 254, 206/264, 268, 274; 229/87.05, 160.2, 229; 383/84, 85, 88, 89

[56] References Cited

U.S. PATENT DOCUMENTS

| | | | |
|---|---|---|---|
| 1,374,956 | 4/1921 | Schneider | 206/268 |
| 2,109,100 | 2/1938 | Brophy . | |
| 2,346,106 | 4/1944 | Hannigan | 206/264 |
| 2,346,407 | 4/1944 | Wright | 206/264 |
| 2,369,387 | 2/1945 | Williamson et al. | 206/268 |
| 2,401,109 | 5/1946 | Rohdin | 383/89 |
| 3,093,292 | 6/1963 | Ahlbor | 206/264 |
| 3,265,287 | 8/1966 | Hovland | 206/273 |
| 4,300,676 | 11/1981 | Focke et al. | 206/264 |
| 4,776,461 | 10/1988 | Focke et al. | 206/271 |
| 4,942,961 | 7/1990 | Focke et al. | 206/254 |

FOREIGN PATENT DOCUMENTS

| | | | |
|---|---|---|---|
| 330938 | 9/1989 | European Pat. Off. . | |
| 857625 | 10/1952 | Fed. Rep. of Germany . | |
| 1043930 | 11/1958 | Fed. Rep. of Germany | 206/273 |
| 2854443 | 7/1980 | Fed. Rep. of Germany . | |
| 3531566 | 3/1987 | Fed. Rep. of Germany . | |
| 3806818 | 9/1989 | Fed. Rep. of Germany . | |
| 3911779 | 10/1990 | Fed. Rep. of Germany . | |
| 3920065 | 10/1990 | Fed. Rep. of Germany . | |

*Primary Examiner*—Paul T. Sewell
*Assistant Examiner*—Marie Denise Patterson
*Attorney, Agent, or Firm*—Sughrue, Mion, Zinn, Macpeak & Seas

[57] ABSTRACT

A package, especially a soft-cup pack for cigarettes is disclosed. An inner wrapping (12) of the soft-cup pack is provided with an opening and withdrawal aid. In the region of an end wall (15), a longitudinal tab (16) is folded out s of the region of the end wall (15). The other longitudinal tab (17) serves as a closure tab for a withdrawal opening (24) which is formed in the central region of the end wall (15). The withdrawal opening (24) is enlarged because parts of side tabs (20, 21) can be moved into the open position a together with the longitudinal tab (17). Additionally, the inner wrapping (12) is provided with a withdrawal aid which is effective in the region of the withdrawal opening (24), in particular with a lift-out strip (44) which is formed from the inner wrapping (12).

9 Claims, 3 Drawing Sheets

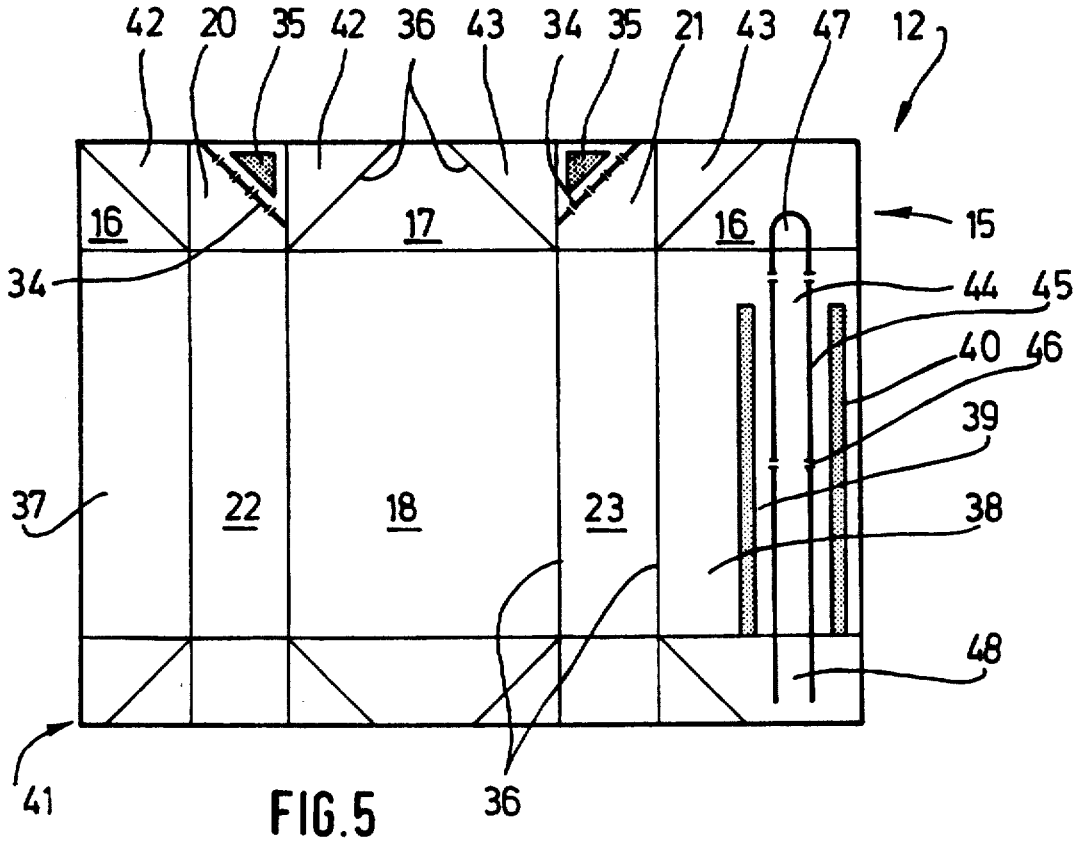
FIG.5
FIG.6
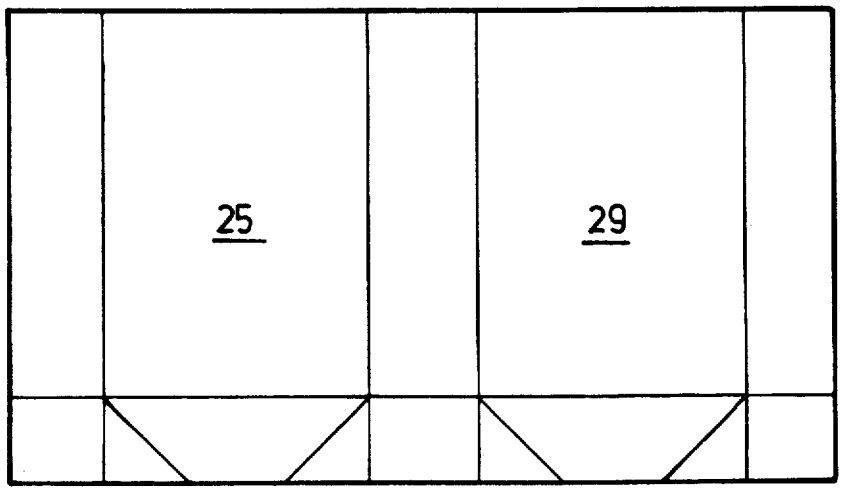

PACKAGE, ESPECIALLY SOFT-CUP PACK FOR CIGARETTES

BACKGROUND OF THE INVENTION

The invention relates to a package, especially a soft-cup pack for cigarettes or the like, having at least one (inner) wrapping which is made of a foldable packaging material and which has two longitudinal tabs in the region of an upper end wall which are connected, on the one hand, to a front wall and, on the other hand, to a rear wall.

The soft-cup type of pack is used world-wide for packaging cigarettes. The pack contents, i.e. a cigarette group, are completely surrounded by an (inner) wrapping. This wrapping is usually made of tin foil, but recently also of coated paper or the like. The block-shaped pack contents are usually surrounded by the wrapping in such a way that an envelope-type folding is formed in the region of an upper end wall. Trapezoidal longitudinal tabs are connected, on the one hand, to the front wall and, on the other hand, to the rear wall of the wrapping. The shape of the longitudinal tabs is formed by a folding in of side tabs which are connnected to the longitudinal tabs and extend elongated side walls of the wrapping.

In a soft-cup pack, the (inner) wrapping which is formed in the way described above is surrounded by a cup usually formed from paper. In the region of the end wall, this cup is open so that the inner wrapping projects slightly from the pack, at least with the end wall. In the case of a cigarette pack, the outer wrapping which is provided is made of cellulose film or plastic film and has to be removed when the pack is put into use.

It is a drawback of the soft-cup packs that the withdrawal of the pack contents, i.e. especially of the cigarettes, requires some effort. Usually, a portion of the end wall is removed manually by tearing in order to form a withdrawal opening. This opening remains open until the pack is emptied.

SUMMARY OF THE INVENTION

The invention is based on the object of developing further and improving packages, especially soft-cup packs, in such a way that the pack permits an easier withdrawal of the pack contents, especially of the cigarettes, and ensures a better protection of the cigarettes after the pack has been opened.

To attain this object, the package according to the invention is characterized in that one of the longitudinal tabs of the end wall, especially the longitudinal tab which is connected to the front wall, rests against the front wall and is attached thereto.

As a result of this design of the pack or the end wall, a central withdrawal opening is formed in the region of the end wall, which opening is covered only by the longitudinal tab which remains in the end wall and is connected to the rear wall. The withdrawal opening extends between the folded side tabs and is exposed for a withdrawal of cigarettes by lifting the longitudinal tab. After a withdrawal of cigarettes, the opening can be reclosed by pivoting the longitudinal tab back into the plane of the end wall.

According to a further proposal of the invention, the longitudinal tab which extends in the end wall can be actuated by a closure means, especially by an adhesive a strip which is connected, on the one hand, to the outer side of the longitudinal tab and, on the other hand, to the front side of the pack, for example to the cup wrapping. The adhesive strip can be grasped with the aid of a grip tab and can be peeled off the front wall of the cup wrapping. When the strip is pulled further, the longitudinal tab is moved out of the plane of the end wall and the withdrawal opening is exposed.

Another important improvement of the invention is that parts of other end wall tabs, especially of the side tabs are connected to the longitudinal tab and can be severed by means of weakening lines, especially perforation lines. As a result, a larger withdrawal opening is formed when the package is opened.

Finally, another subject matter of the invention is the provision of a withdrawal aid for the cigarettes in the from of a lift-out strip which is integrated into the inner wrapping.

BRIEF DESCRIPTION OF THE DRAWINGS

Further details of the invention will be described below in detail with reference to an exemplary embodiment illustrated in the drawings, in which:

FIG. 5 shows an unfolded blank for the (inner) wrapping, FIG. 6 shows an unfolded blank for the cup wrapping.

DESCRIPTION OF A PREFERRED EMBODIMENT

Figure 1:
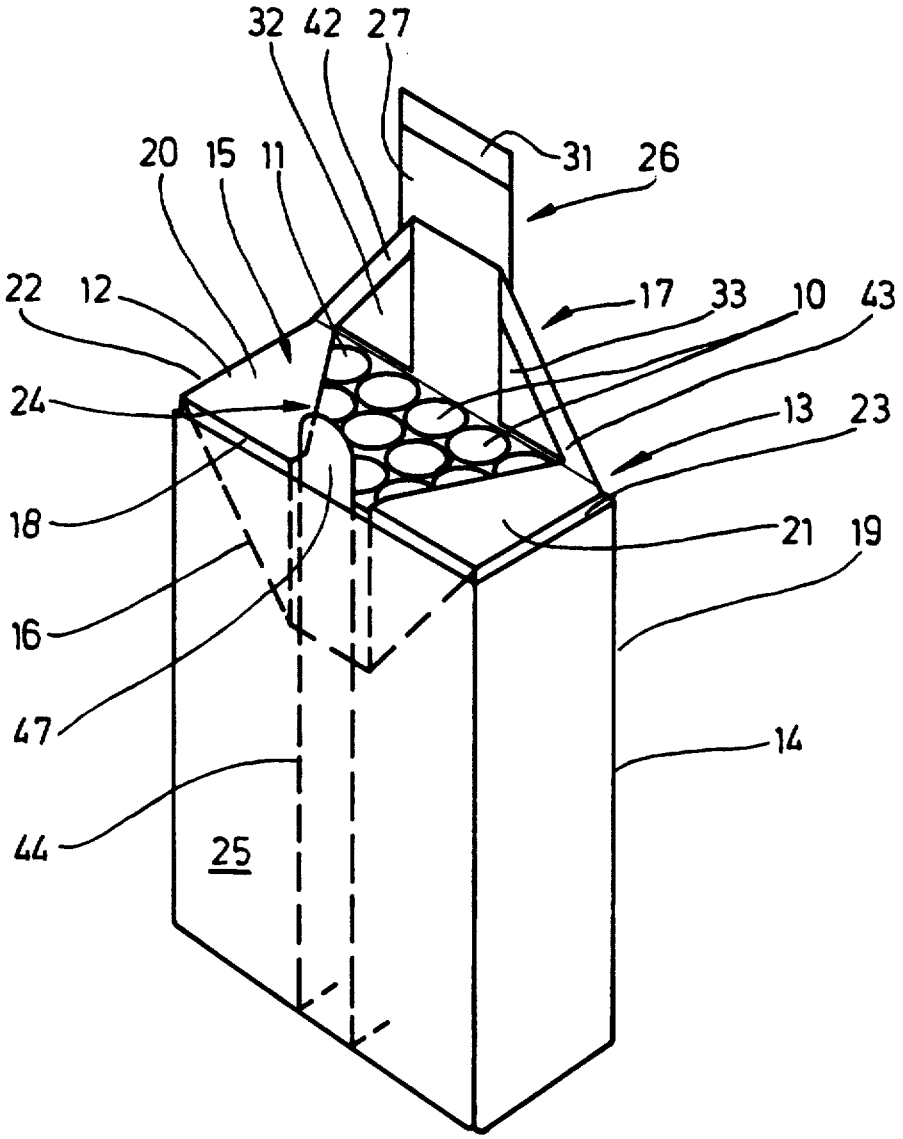
FIG. 1 shows a perspective view of a soft-cup pack for cigarettes in the open position.

The preferred exemplary embodiment illustrated in the drawings relates to a soft-cup pack for cigarettes 10. A cigarette group 11 is surrounded by an inner wrapping 12. This inner wrapping is made of a foldable packaging material, especially tin foil, paper or the like. The cigarette group 11 is surrounded by the inner wrapping 12 on all sides, such that a block-shaped structure, namely a cigarette block 13 is formed.

The cigarette block 13 is located in a cup-shaped outer wrapping which is open at the top, namely in a cup wrapping 14. This cup wrapping is usually made of paper or another thin and foldable packaging material. The cup wrapping 14 is open at the top, so that the cigarette block 13 projects slightly from the cup wrapping 14. An end wall 15 of the inner wrapping 12 is exposed.

The end wall 15 of the inner wrapping 12 is designed in a special way and is formed from several end wall tabs. These end wall tabs are, on the one hand, two trapezoidal longitudinal tabs 16 and 17. Both of these tabs are connected to walls of the inner wrapping 12 which have a large surface area. In the illustrated example, the longitudinal tab 16 is connected to a front wall 18 and the longitudinal tab 17 to a rear wall 19. On the other hand, the end wall 15 is formed from side tabs 20, 21 which are folded against the ends of the cigarettes 10. These side tabs 20, 21 are connected to the side walls 22, 23 of the inner wrapping 12 and are folded from the narrow sides of the end wall 15 into their proper position in the pack.

A withdrawal opening 24 for the cigarettes 10 is formed in the region of the end wall 15. The withdrawal opening 24 is located in the central region of the end wall 15 and extends over the entire width of the end wall. The withdrawal opening 24 is bounded laterally by the side tabs 20, 21.

The withdrawal opening 24 can be closed by only one longitudinal tab, in the present case by the longitudinal tab 17 which is connected to the rear wall 19. In the central region, this longitudinal tab 17 corresponds to the width of the end wall 15, so that the withdrawal opening 24 is completely covered by the longitudinal (closure) tab 17 in the closed position.

To expose the withdrawal opening 24, the other longitudinal tab, i.e. in this case the longitudinal tab 16 which is connected to the front wall 18, is durably removed from the region of the end wall 15. For this purpose, the longitudinal tab 16 is folded against the front wall 18 and fixed in this position. In the exemplary embodiment illustrated, the longitudinal tab 16 is retained on the front wall 18 by the cup wrapping 14. Consequently, the longitudinal tab 16 extends between a cup front wall 25 of the cup wrapping 14 and the front wall 18 of the inner wrapping 12. As a result, the other longitudinal tab 17 is the only closure tab for the withdrawal opening 24.

Figure 2:
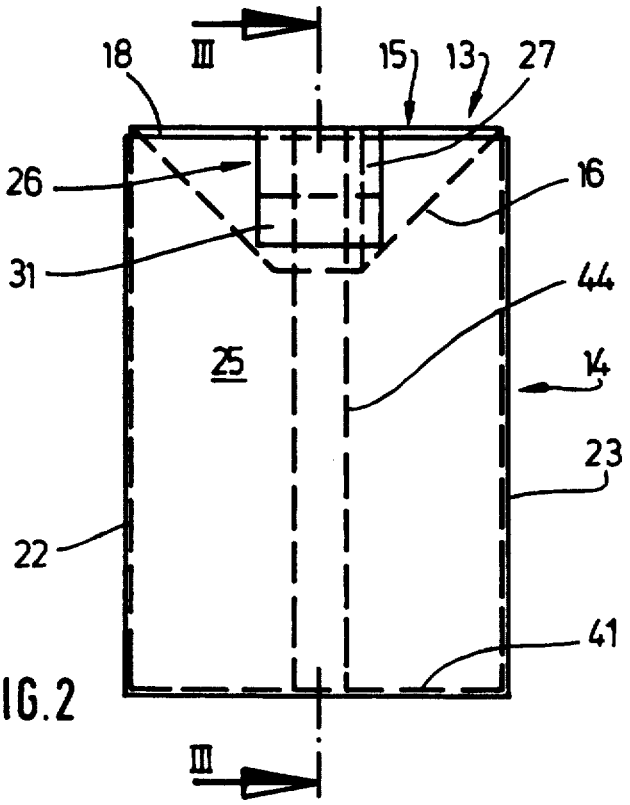
FIG. 2 shows a front wall of the package of FIG. 1 in the closed position.
Figure 3:
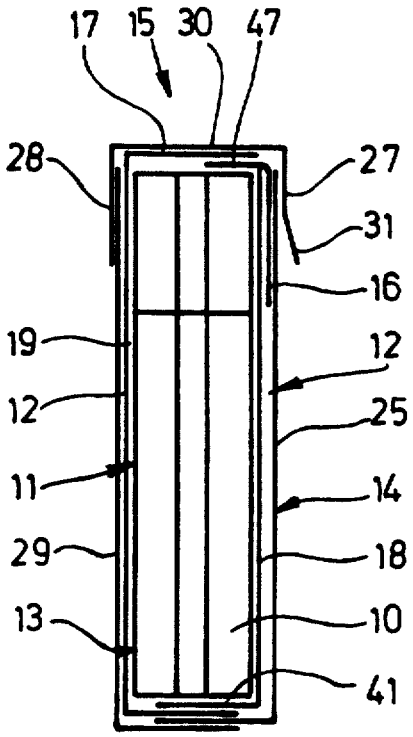
FIG. 3 shows a vertical section of the package of FIG. 2 taken along line III—III.

An opening and closing aid is associated with the longitudinal tab 17 so that the pack can be readily opened and reclosed after cigarettes have been withdrawn. In this case, the opening and closing aid is an adhesive strip 26 which extends, in the closed position of the pack (FIG. 2 and FIG. 3), in the transverse direction across the end wall 15, with legs 27 and 28 extending in the region of a cup rear wall 29 and in the region of the cup front wall 25. A central portion 30 of the adhesive strip 26 is connected to the longitudinal tab 17. The leg 27 which rests on the front side of the package on the cup front wall 25 is provided with an adhesive-free grip end 31. The adhesive strip 26 can be grasped at this grip end and can be peeled off the cup front wall 25 and pivoted back, thereby taking along the longitudinal tab 17 acting as a closure tab. As a result, the withdrawal opening 24 is exposed. In the opposite direction of movement, the pack is reclosed and the leg 27 is attached to the cup front wall 25 adhesively.

The adhesive strip 25 may be a conventional tape or a revenue stamp or another closure means. If it is not intended to provide a reclosure facility, a paper label could hold the longitudinal tab 17 in the closed position before the package is put into use.

In the present case, the withdrawal opening 24 is enlarged, in particular with a transverse dimension which increases towards the rear wall 19. As a result, the withdrawal opening 24 receives a trapezoidal shape with a dimension which corresponds to the width of the end wall. The withdrawal opening 24 is enlarged by moving marginal portions of the side tabs 20, 21 along into the open position when the pack is opened for the first time.

In the present exemplary embodiment, triangular marginal portions 32, 33 of the side tabs 20, 21 are connected to the confronting inner side of the longitudinal tab 17 in such a way that these marginal portions 32, 33 are severed from the side tabs 20, 21 and thus moved along to the open position when the package is opened for the first time.

The marginal portions 32, 33 are marked within the side tabs 20, 21 by a tearing or weakening line, in the present case by an inclined perforation line 34. The marginal portions 32, 33 are severed from the side tabs 20, 21 along this perforation line 34 by means of lifting the longitudinal tab 17. This is made possible by the connection of the marginal portions 32, 33 to the longitudinal tab 17. In the present exemplary embodiment, the marginal portions 32, 33 are connected to the longitudinal tab 17 by triangular glue areas 35.

The inner wrapping 12 is formed from a rectangular blank as shown in FIG. 5. Walls and folding tabs are marked in this blank by folding lines 36. In this blank, the folding tabs for forming the end wall 15 are designed such that they correspond in width to the corresponding dimension of the end wall 15. Consequently, the longitudinal tab 17 covers the entire width of the end wall 15 in the central region.

When the package or cigarette block 13 is produced, the blank is folded in a tubular manner around the pack contents. In the present example, the blank is divided in the region of the front wall 18. Front wall tabs 37 and 38 of unequal width cover one another partially in order to form the front wall 18. The front wall tabs 37, 38 are connected to one another by adhesive bonding, and in the present exemplary embodiment by two upright glue strips 39 and 40 located in spaced relationship. The arrangement is such that the greater or wider front wall tab 38 is located on the inside, i.e. rests against the cigarettes 10, whereas the shorter front wall tab 37 rests on the outside and is connected to the front wall tab 38 by the adhesive strips 39, 40 which extend in this region.

In the tubular intermediate folding position of the inner wrapping 12, the folding tabs for, on the one hand, the end wall 15 and, on the other hand, a bottom wall 41, project beyond the pack contents. First of all, the side tabs 20, 21 which extend the side walls 22. 23 are folded inwards against the pack contents. In this process, triangular folding gussets 42, 43 which are part of the longitudinal tabs 16, 17 and are defined by inclined folding lines 36 are folded against the inside of the longitudinal tabs 16, 17. As a result, the longitudinal tabs 16, 17 receive their trapezoidal shape. In the region of the folding gussets 42, 43, the longitudinal tabs have two plies. The folding gussets 42, 43 adjoin the side tabs 20. 21. In this a case, the marginal portions 32, 33 of the side tabs 20, 21 are of triangular shape and are connected to the immediately adjacent folding gussets 42, 43 by the glue areas 35.

The bottom wall 41 has a similar design. It has trapezoidal longitudinal tabs and side tabs, similar to the structure of the end wall 15.

A blank for the cup wrapping 14 is shown in FIG. 6. This blank has a structure which is similar to that of the blank for the inner wrapping 12. There are no folding tabs for an end wall because the cup wrapping 14 is open in this region. Moreover, the overlap resulting from the tubular folding is not located in the region of front or rear wall, but in the region of a cup side wall.

The exemplary embodiment of the package which is illustrated in the drawings is provided with a withdrawal aid for the cigarettes 10. The inner wrapping 12 has a lift-out strip 44 in the region of the front wall 18. This lift-out strip forms part of the front wall 18 of the inner wrapping 12 and is defined by punchings 45 having only a few residual connections 46. The lift-out strip 44 extends with a grip tongue 47 into the region of the longitudinal tab 16 of the end wall 15. At the bottom end, the lift-out strip 44 is extended with a lifting leg 48 into the region of the bottom wall 41 or a longitudinal tab of the bottom wall 41. Moreover, the lift-out strip 44 extends between the two glue strips 39, 40. These glue strips are located on both sides of the lift-out strip 44 at a small distance therefrom, so that the lift-out strip is stabilized or fixed by the glue strips 39, 40.

Figure 4:
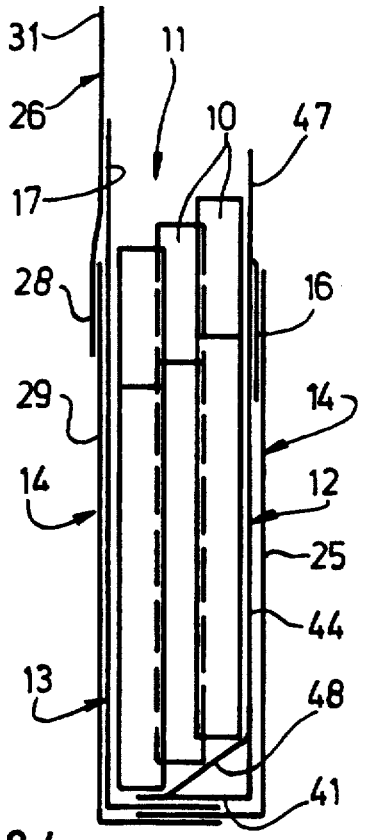
FIG. 4 shows a representation, similar to FIG. 3, of the package in the open position.

When the inner wrapping 12 is produced the grip tongue 47 is folded out of the plane of the longitudinal tab 16 in such a way that the grip tongue 47 is not folded against the front wall 18 with the longitudinal tab 16. In the closed position of the pack, the grip tongue 47 extends in the plane of the end wall 15. The grip tongue 47 is exposed when the longitudinal tab 17 is lifted and can be grasped by hand. When the lift-out strip is pulled up, the residual connections 46 are destroyed first. Thereafter, several cigarettes are lifted from the plane of the bottom wall 41 by the pulled-up lifting leg and are thus moved to a withdrawal position (FIG. 4).

We claim:

1. A soft-cup pack (10) for cigarettes with a cup-shaped outer wrapping (14) and an inner wrapping (12) which is made of foldable packaging material and which has two side tabs (20, 21) in an upper end wall (15), which are each connected to a side wall (22, 23) of the inner wrappings (12), and first and second longitudinal tabs (16, 17) which are connected to a front wall (18) and to a rear wall (19), respectively, of the inner wrapping (12), the improvement wherein:

a) said first longitudinal tab (16) connected to the front wall (18) is folded such that it rests in a position against the front wall (18) and is fixed in said position;

b) said second longitudinal tab (17) connected to the rear wall (19) is located in the plane of the upper end wall (15) in a closed position of the pack;

c) in the closed position the second longitudinal tab (17) covers a withdrawal opening (24) which is formed within the upper end wall (15) of the inner wrapping (12), and which is bounded laterally by the side tabs (20, 21) forming part of the upper end wall (15);

d) in the closed position the second longitudinal tab (17) is retained by an adhesive closure means (26) which is connected to an outside of the second longitudinal tab (17) and to a front wall (25) of the cup-shaped outer wrapping (14);

e) the adhesive closure means has a leg (27) which is connected to the front wall (25) of the cup-shaped outer wrapping (14) and which has an adhesive-free grip end (31) which can be peeled off, and wherein the second longitudinal tab (17) is movable into an opening position by a pulling back of said closure means.

2. The soft-cup pack as claimed in claim 1, wherein the first longitudinal tab (16), resting against the front wall (18) of the outer wrapping (14) is retained int he fixed position by the cup-shaped outer wrapping (14).

3. The soft-cup pack as claimed in claim 1 or 2 wherein, in order to enlarge the withdrawal opening (24), marginal portions (32, 33) of the side tabs (20, 21) are severable from the side tabs (20, 21) and are movable into an open pack position together with the second longitudinal tab (17).

4. The soft-cup pack as claimed in claim 3, wherein the severable marginal portions (32, 33) as defined int he side tabs (20, 21) by perforation lines (34), and are connected to the second longitudinal tab (17) by adhesive bonding areas (35).

5. The soft-cup pack as claimed in claim 4, wherein the marginal portions (32, 33) of the side tabs (20, 21) have a triangular shape such that the withdrawal opening (24) has a width which increases in a direction towards the rear wall (19) of the cup-shaped inner wrapping.

6. The soft-cup pack as claimed in claim 5, wherein the withdrawal opening (24) and the second longitudinal tab (17) have the same width as the upper end wall (15).

7. The soft-cup pack as claimed in claim 1, comprising a withdrawal aid for the cigarettes (10) in the form of a lift-out strip (44) located in a region of the front wall (18) of the inner wrapping (12), wherein a grip tongue (47) is formed in a region of the first longitudinal tab (16) as an upper end of the lift-out strip (44) and extends freely in order to be grasped.

8. The soft-cup pack as claimed in claim 7 wherein the lift-out strip (44) is disposed in a region of an inner and wider front wall tab (38) and is formed out of two partially overlapping front wall tabs (37, 38) which form the front wall (18) of the inner wrapping (12).

9. The soft-cup pack as claimed in claim 8, wherein the lift-out strip (44) extends between two glue strips (29, 40) which also serve for connecting the front wall tabs (37, 38).

* * * * *